US005235921A

United States Patent [19]

Dunham

[11] Patent Number: 5,235,921

[45] Date of Patent: Aug. 17, 1993

[54] COMBUSTION SYSTEM HAVING A MOVABLE HEARTH

[75] Inventor: Richard M. Dunham, Houston, Tex.

[73] Assignee: Dunham Environmental Services, Inc., Houston, Tex.

[21] Appl. No.: 789,859

[22] Filed: Nov. 8, 1991

[51] Int. Cl.[5] ..... F23H 7/08; F23H 7/14

[52] U.S. Cl. ..... 110/282; 110/278; 110/300

[58] Field of Search ..... 110/278, 281, 282, 298, 110/308

[56] References Cited

U.S. PATENT DOCUMENTS

| | | | |
|---|---|---|---|
| 1,374,125 | 4/1921 | Wagoner | 110/282 |
| 2,932,264 | 4/1960 | Hurst | 110/282 |
| 3,958,920 | 5/1976 | Anderson | 432/23 |
| 4,046,085 | 9/1977 | Barry | 110/12 |
| 4,241,671 | 12/1980 | Joyner et al. | 110/188 |
| 4,279,208 | 7/1981 | Guillaume et al. | 110/346 |
| 4,341,199 | 7/1982 | Hand, Jr. et al. | 110/300 |
| 4,491,077 | 1/1985 | Petty et al. | 110/278 |
| 4,510,873 | 4/1985 | Shigaki | 110/282 |
| 4,563,959 | 1/1986 | Fujiwara | 110/278 |
| 4,586,442 | 5/1986 | Caughey | 110/278 |
| 4,667,609 | 5/1987 | Hardison et al. | 110/236 |
| 4,676,741 | 6/1987 | Pargeter | 432/142 |
| 4,702,178 | 10/1987 | Welsh | 110/193 |
| 4,771,710 | 9/1988 | Cocchi | 110/281 |

*Primary Examiner*—Henry C. Yuen
*Attorney, Agent, or Firm*—Harrison & Egbert

[57] ABSTRACT

The present invention is a combustion chamber for an incinerator that has a chamber with a plurality of refractory walls and an opening for the delivery of materials into the chamber. A hearth is contained within the chamber. The hearth has a surface for the receipt of these materials and is positioned generally adjacent to the opening. An oscillator is connected to the hearth for causing the hearth to oscillate within the chamber. An air plenum is arranged beneath the hearth. The hearth has a first and second flange extending upwardly along each side of the hearth. A third flange extends upwardly at the end of the hearth adjacent to the chamber opening. The hearth has a plurality of air passageways extending therethrough and communicating with the air plenum. A collection ridge is formed about one edge of the hearth. A suitable heat exchange fluid circulating system is provided within the hearth so as to pass a fluid and heat exchange relationship with the hearth.

15 Claims, 4 Drawing Sheets

COMBUSTION SYSTEM HAVING A MOVABLE HEARTH

TECHNICAL FIELD

The present invention relates to hearths for an incinerator. More particularly, the present invention relates to movable hearths having air passageways extending therethrough and having heat exchange systems contained therein.

BACKGROUND ART

Incineration provides acceptable means for disposing of waste, oxidation of materials, and for recovery of heat from burning refuse; however, the process of incineration has had imposed on its use severe and substantial limitation. Some incinerators require removal of materials not fully combustable in prior systems or burnable only with undesirable side effects or hazards; thus a sorting step is necessary for use of such processes and equipment. Other incinerators need shredded material for burning and that prerequisite also requires extra processing and equipment. Most prior art incinerators are incapable of meeting environmental standards, and require one or more of a wide range of auxiliary equipment, such as afterburners, scrubbers, precipitators and the like to make them function properly.

Even with suitable pre-incineration processes and equipment and auxiliary environmental protection devices, full combustion of random refuse material is seldom achieved, because adequate oxygenation of the burning particles is required, although the burning cannot be so rapid as to make the fire to hot or permit excessive gasification or atomization of the burning particles or the products of combustion. Optimum non-polluting combustion requires close control of the time, turbulence and temperature of the burning process. The problem is further magnified when the refuse contains plastics, wet refuse and liquids and when unburned particles are permitted to escape from the main burning chamber.

The main burning chamber of an incinerator has a hearth floor. The use of a hearth has some inherent problems requiring solution for effective and efficient combustion of random refuse. The refuse on the hearth must receive an even distribution of oxygen for the material to burn. Air must be mixed with the burning material and dispersed. Air alone, particularly with high velocities, will entrain and lift burning particles before they are fully consumed. The uncontrolled rapid burning of the pile may also increase velocities. Such high velocities and the accompanying incomplete burning results in slagging and tends to clog up the incinerator floor, as well as to permit incompletely burned particulates and products of combustion to exit the main burning chamber of the incinerator before they are adequately consumed.

A variety of United States patents have addressed the problems of incinerator hearths. A variety of configurations have been described for the solving of various problems.

U.S. Pat. No. 4,706,578, issued on Nov. 17, 1987, describes a pulsating incinerator hearth in which the hearth is suspended on a fixed frame for movement in a limited short arc so as to urge random sized particles to move along a predetermined path along the surface of the hearth. The movement is imparted to the hearth in periodic pulses by inflating airbags mounted on the frame. These airbags stroke the hearth so as to move it a short distance from an initial position and to jar it against the frame. This causes the burning particles to move a short distance by inertia. In addition, this hearth also includes a plurality of nozzles that are connected to a source of air for delivering gently flowing air to the burning pile on the hearth.

U.S. Pat. No. 4,491,077, issued on Jan. 1, 1985, also discusses a vibrating hearth burner. This vibrating hearth provides uniformity of fuel combustion by providing a burner in which the grate and the vibrating mechanism cooperate to decelerate the movement of fuel across the grate as it travels toward the discharge end. This device utilizes an ash return shute which is incorporated into the vibrating grate assembly. The vibrating assembly keeps the ash in motion as it returns to the rear end adjacent the delivery end of the grate. There is an air flow through the fuel material on the grate.

U.S. Pat. No. 4,771,710, issued on Sep. 20, 1988, shows a stepwise grid for waste incineration furnaces having improved air circulation and air tightness. Specifically, this device includes side joint coverings that protrude from one side of the grid. The side joint coverings secure the tightness against the infiltration of waste between the adjacent steps of the process. This invention shows a moving hearth in combination with such covered joints.

Various other moving hearth furnaces are disclosed in U.S. Pat. Nos. 4,702,178, 4,667,609, and 4,241,671. In these moving hearth type furnaces, air is circulated for the purpose of increasing the burn on the hearth. U.S. Pat. Nos. 3,958,920 and 4,046,085 describe moving hearth furnaces where the air is controlled for a complete burn of waste products.

Importantly, none of the prior art devices have recognized the need for the cooling of the metal hearth during the burn process. As such, although the moving hearths attempt to cause the burned particles to move, they do not accommodate the problem of slag accumulation. Also, these are not effective for the containment of the ash particles within the primary combustion chamber. During the combustion process, the ashen materials are generally left free to disperse throughout the hearth region. As a result, significant clogging or damage is caused by the uncontrolled distribution of ash particles.

The above-stated problems are particularly important in the disposal of medical wastes. Medical wastes are often hazardous. As such, it is particularly important to have a complete burn of the materials introduced into the incinerator. It is dangerous and destructive to leave certain hazardous medical wastes unburned. As such, it is important to contain the materials on the hearth during the burning process. Also, much of the medical waste is liquid. Whenever a liquid is introduced to a hearth, it tends to disperse quickly and to flow everywhere. As such, it is important to design a hearth that effectively contains any liquid medical waste on the hearth until the burning of such waste is completed.

It is an object of the present invention to provide a hearth that effectively contains the materials until a complete burn is achieved.

It is another object of the present invention to provide an improved hearth that effectively contains and destroys liquid waste.

It is another object of the present invention to provide a hearth that prevents slag accumulation.

It is still object of the present invention to provide an oscillation hearth within a combustion chamber which allows the burned particles to pass in a systematic manner to a receptacle.

These and other objects and advantages of the present invention will become apparent from a reading of the attached specification and appended claims.

SUMMARY OF THE INVENTION

The present invention is a hearth for an incinerator comprising a body having a surface for the receipt of waste materials, a heat exchange fluid circulation system formed on the interior of the hearth so as to pass a fluid in heat exchange relationship with the body, and an oscillator connected to the body for enabling the body to oscillate in a desired pattern.

The body of the hearth of the present invention comprises a first flange that extends upwardly above the surface on one side of the body and a second flange that extends upwardly above the surface on another side of the body opposite the first flange. A third flange is formed at the end of the body and extends upwardly therefrom. The first, second and third flanges are formed for the purposes of containing the materials on the surface of the hearth body. At the end of the surface of the hearth body, opposite the third flange, is a collection ridge that is formed along the edge of the body. This collection ridge serves to retain fluids on the surface of the body.

The body has a plurality of air passageways that extend therethrough. These air passageways open on the surface of the body, extended through the thickness of the body, and open on the opposite side of the body. Specifically, each of the air passageways comprises a tube that extends through the body. This tube extends a small distance above the surface of the body. This tube serves to prevent fluids from flowing through the tube into the air plenum of the hearth.

The heat exchange fluid circulation system includes a fluid passageway that is contained within the body. This fluid passageway serves to pass either air, water, or other fluids in close proximity to the surface of the body. Air, water or other fluids can act as the heat transfer fluid.

The oscillator comprises a motor that is interconnected to the body. This motor acts on the body so as to cause the body to move in an up-down backward-forward motion pattern. This motion pattern causes any ash buildup on the surface on the hearth to gradually drift toward the end of the hearth having the collection ridge. As the ash is accumulated, the ash will fall over the collection ridge into an ash receptacle.

The present invention is also a combustion chamber for an incinerator that comprises a chamber having a plurality of refractory walls, a hearth contained within the chamber, and an oscillator connected to the hearth for causing the hearth to oscillate within the chamber. The chamber includes an opening for the delivery of materials into the interior of the chamber. The hearth has a surface thereon for the receipt of such materials. The hearth is positioned generally adjacent to the opening. An air plenum is arranged beneath the hearth in the chamber. The hearth is positioned within the chamber such that pressurized air from the air plenum passes around the sides of the hearth so as to act as an air barrier to the dispersal of ash from around the sides of the hearth. The hearth has a configuration as described herein previously.

An ash receptacle is formed in the chamber adjacent to an end of the hearth opposite the opening. The ash receptacle is defined by a plurality of refractory walls. At least one of these refractory walls serves to separate the ash receptacle from the air plenum.

The hearth has a plurality of air passageways extending therethrough. These air passageways communicate with the air plenum such that pressurized air from the air plenum passes through such air passageways to above the surface of the hearth. The heat exchange fluid circulation system serves to cool the surface of the hearth so as to prevent the buildup of slag and other materials. A suitable supply of the heat exchange fluid is connected to the circulation system exterior of the chamber. This fluid supply serves to deliver the heat exchange fluid to the circulation system of the hearth. Any pumping mechanism connected to the heat exchange fluid supply should be of a sufficient capacity so as to maintain the desired hearth temperature.

DETAILED DESCRIPTION OF THE INVENTION

Figure 1:
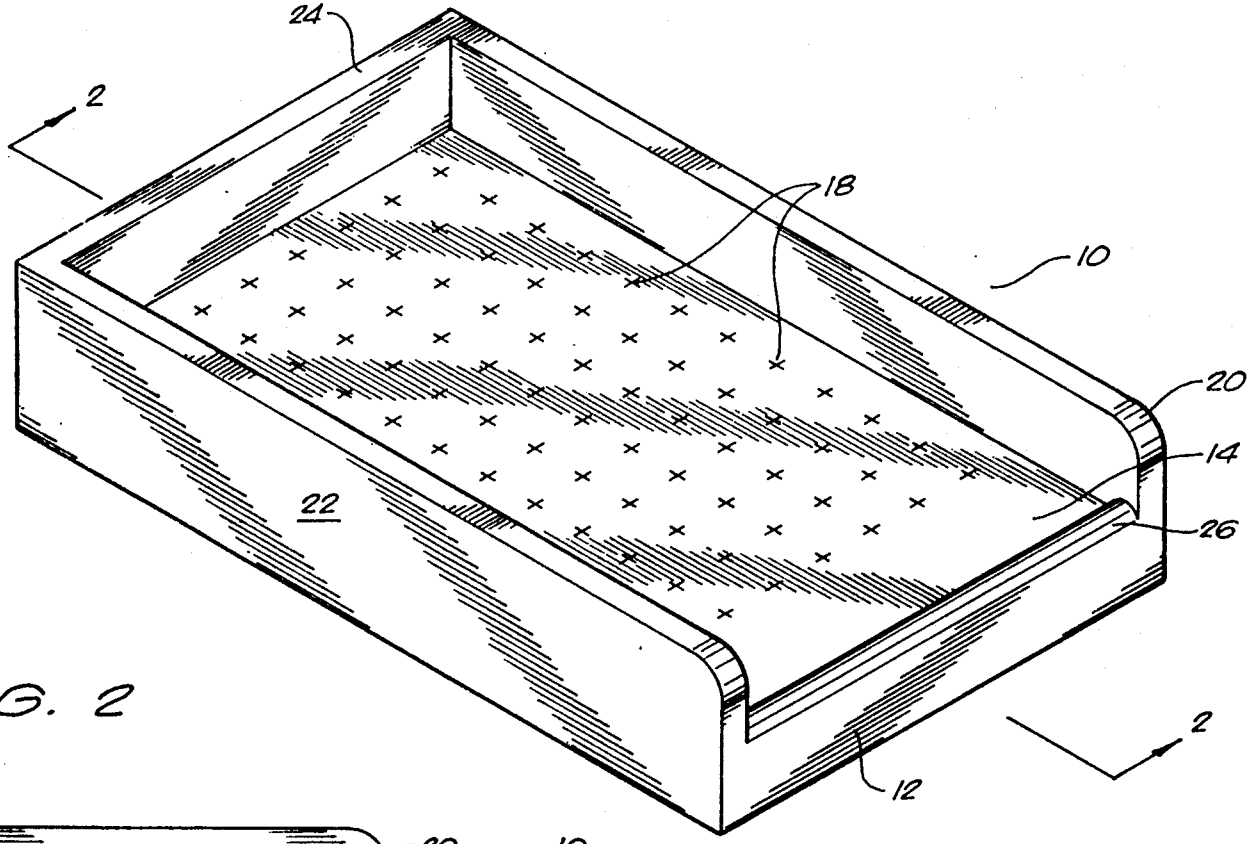
FIG. 1 is a perspective view of the hearth of the present invention.

Referring to FIG. 1, there is shown at 10 the hearth in accordance with the preferred embodiment of the present invention. Hearth 10 comprises a body 12 having surface 14. Body 12 is a generally rectangular configuration forming the length and the width of the hearth of the present invention. Surface 14 defines the top surface of body 12. Surface 14 receives the deposit of the materials for incineration. The crosshatched portions 18 illustrate the positioning of the air passageways extending through the body 12 and opening at surface 14. These air passageways 18 are illustrated in greater detail in connection with the descriptions of FIGS. 2 and 3.

A first flange 20 extends upwardly above the surface 14 along one side of body 12. Similarly, a second flange 22 extends upwardly above the surface 14 along the opposite side of body 12. Flanges 20 and 22 act as barriers to the movement of materials over the sides of the surface 14 of hearth 10. Each of the flanges 20 and 22 extend upwardly for the length of body 12. A third flange 24 extends upwardly above the surface 14 at an end of the body 12. In use, the third flange 24 is positioned adjacent to the area in which material is deposited onto the hearth 10. Flanges 20, 22 and 24 are integrally connected together so as to define a three-sided wall for the retention of material deposited on surface 14 of body 12. At the end opposite the flange 24 is a collection ridge 26. Collection ridge 26 extends between the side flanges 20 and 22. Collection ridge 26 rises a small distance above the surface 14. In use, collection ridge 26 serves to retain any liquid material on the surface 14. In the use of the hearth of the present invention, it is important that any liquid materials be contained on the surface 14 so that they may be properly incinerated. The collection ridge 26 serves to prevent the flow of materials over the open end of the hearth 10.

Figure 2:
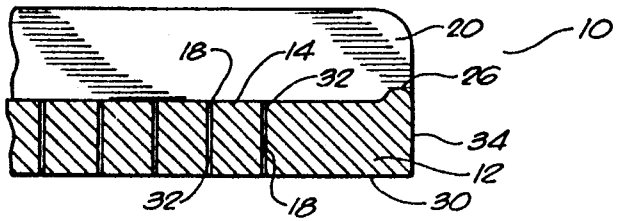
FIG. 2 is a cross-sectional view as taken across lines 2—2 of FIG. 1.

Referring to FIG. 2, a partial cross-sectional view of the hearth 10 is shown. Specifically, it can be seen how the side flange 20 extends upwardly above the surface 14 of the hearth 10. The body 12 is shown in its proper position in relation to the side flange 20.

Of particular significance, in FIG. 2, is the configuration of the air passageways 18. As has been stated previously, the body 12 has a plurality of air passageways extending therethrough. These air passageways open on the bottom surface 30 of body 12. These air passageways extend through the body 12 so as to open at the top surface 14. As can be seen, the top surface 14 is on the opposite side of the body from that of the bottom surface 30. Specifically, each of the air passageways 18 comprises a tube 32. As can be seen, the end of the tube 32 adjacent to the top surface 14 extends outwardly a small distance above the top surface of the body. It is important that the tube member 32 extend outwardly above the top surface 14 so as to prevent the flow of liquids into the air passageways 18. Since each of the air passageways 18 extends above the top surface, any fluid will continue to reside on the top surface 14 until it is completely incinerated or thermally converted as desired. If the tubes 32 were level with the top surface 14, then any liquid would have a tendency to flow through the air passageway 18 and into the air plenum therebelow. This tendency is resisted whenever the tube 32 extends above the top surface 14 a small distance. Of course, in the normal use of the hearth of the present invention, certain fluids will, in small quantities, splash into the air passageways 18. It is believed that the heat of the air passing through the air passageway 18 should be sufficient to incinerate and/or vaporize any liquids before such liquids would pass into the air plenum therebelow. The upward flow of pressurized air from the plenum 48 below the hearth 12 will also tend to deter fluids from passing down through tubes 18.

Also, in FIG. 2, it can be seen that the collection ridge 26 rises a small distance above the top surface 14 of body 12. The collection ridge 26 is located at the end 34 of body 12. Collection ridge 26 has a smooth contoured surface. The purpose of the collection ridge 26 is to retain any liquids on the top surface 14 while allowing any build-up of ash or incinerated material to eventually pass over the collection ridge 26 and into an ash receptacle located outside of the surface 34 of body 12.

Figure 3:
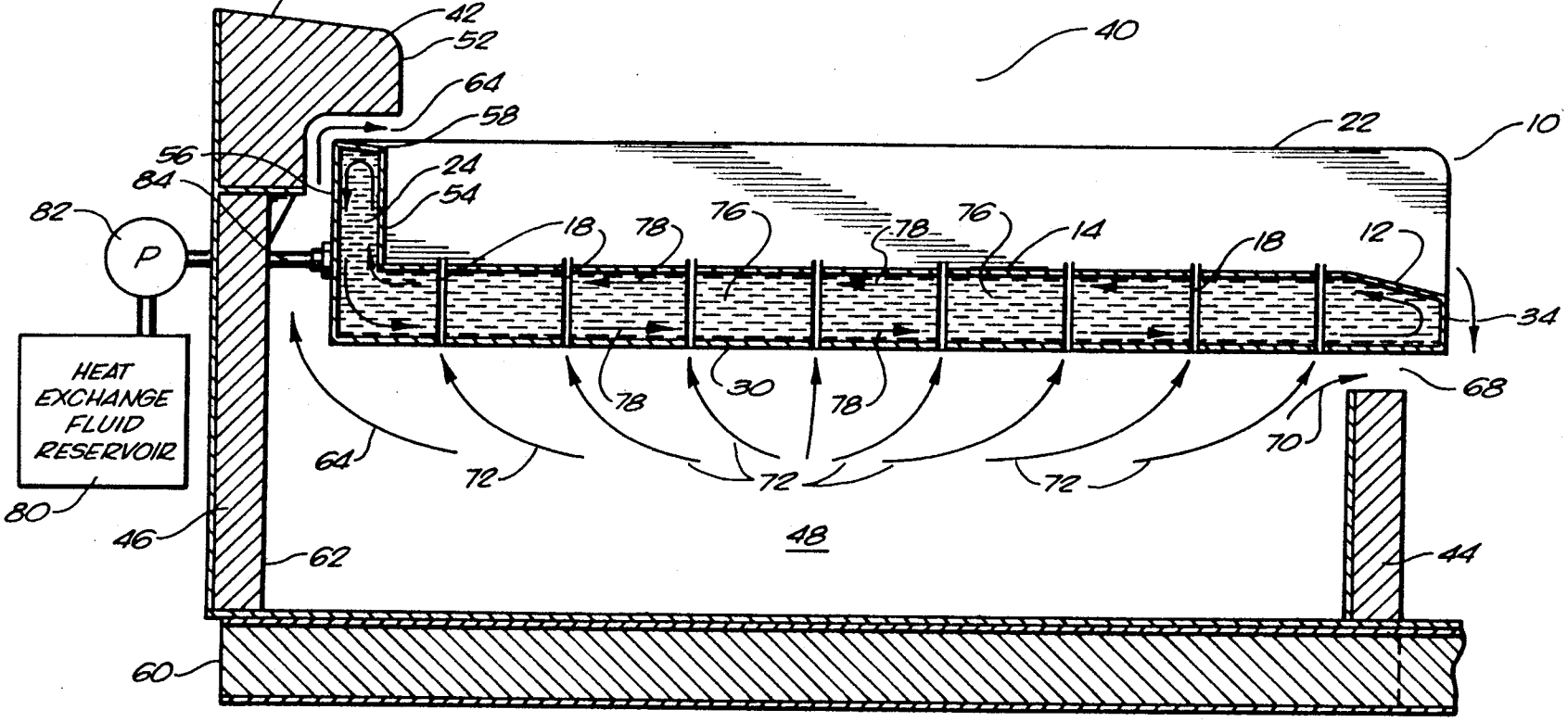
FIG. 3 is a cross-sectional view of the portion of the combustion chamber of the present invention.

FIG. 3 illustrates the hearth 10 as positioned within incinerator 40. Initially, it can be seen that the incinerator 40 includes a plurality of refractory walls 42, 44 and 46. Refractory walls 44 and 46 define the area of the air plenum 48 located beneath the hearth 10 within the combustion chamber 40. Initially, the refractory wall 42 has a roughly L-shaped configuration. The top edge 50 of the refractory wall 42 is a slightly downwardly inclined surface. In use, the surface 50 will allow for the passage of materials over surface 50 to the surface 14 of hearth 10. The material will then be pushed by the ram so as to pass over the surface 52, and onto the surface 14 of hearth 10. The material to-be- incinerated will reside between the side flanges 20 and 22 of hearth 10. It can be seen that the end flange 24 is roughly aligned with and slightly behind the surface 52 of refractory wall 42. The end wall 24 has an inner surface 54 and an outer surface 56. Between the inner wall 54 and the outer wall 56 is a slightly inclined top edge 58. The top edge 58 is inclined such that the inner edge, adjacent to wall 54, is lower than the outer edge, adjacent to wall 56. This inclination further assists in the depositing of materials from the top edge 50 onto the surface 14 of hearth 10.

It can be seen that refractory wall 46 extends upwardly from the base 60. Refractory wall 46 connects with the refractory wall 42. The area between the inner wall 62 of refractory wall 46 and the outer surface 56 of the hearth 10 forms an air passageway in which air from the air plenum 48 can pass, under pressure, upwardly therethrough. Arrow 64 illustrates the pathway in which air travels so as to follow this flow pattern. The pressurized air passing through this passageway acts as an air barrier to prevent any materials that have been deposited on the surface 14 from flowing back through the passageway between the refractory walls 42 and 46 and the hearth 10. The base 60 defines a hearth access pit located beneath the air plenum 48. Refractory wall 44 extends upwardly above the base 60 generally adjacent to the end 34 of hearth 10. Refractory wall 44 defines the end of the air plenum 48 in relation to the hearth 10. Each of the refractory walls is made of an insulating material that serves to keep the heat of the combustion chamber 40 on the interior of the combustion chamber. It can also be seen that the opening 68 located between the top of refractory wall 44 and the bottom surface 30 of hearth 10 also accommodates the passage of air, under pressure, as illustrated by arrow 70. As such, any materials that have been burned on the hearth 10 are prevented from entering the air plenum 48 by way of this air barrier 70.

As can be seen, a plurality of air passageways 18 open at the bottom side 30 of hearth 10 at the air plenum 48. As represented by arrow 72, the air in the air plenum 48 will pass through these passageways 18 under pressure onto the top surface 14 of the hearth 10. This air assists in the combustion of any products that are located on the surface 14 of hearth 10. It should also be noted that the air from the air plenum 48 also passes along the side flanges 20 and 22 of the hearth 10. Specifically, the air will pass between the refractory wall of the air plenum 48 and the exterior surface of the side flanges 20 and 22. As such, the air from the air plenum 48 will continue to act as an air barrier for the purpose of preventing any materials on surface 14 from entering into the air plenum 48. In all respects, the design of the present invention provides an effective air barrier to the intrusion of any materials into the air plenum 48. As described herein previously, pressurized air passes along the metal hearth 10 along all four sides. As such, there is not an area available in which such material intrusion could occur. All wastes, toxic and otherwise, are maintained on or above the hearth. This design of the present invention provides an effective burn of all materials on the hearth.

Importantly, in FIG. 3, it can be seen that the interior 76 of body 12 of hearth 10 is generally hollow. As illustrated in FIG. 3, the interior 76 can be hollow, or can be filled with a plurality of heat exchange tubes. The purpose of the interior 76 is to provide a suitable heat exchange fluid circulation system on the interior of hearth 10. The arrows 78 represent the flow of any heat exchange fluid throughout the interior of the hearth 10. As can be seen, the heat exchange fluid 78 passes in a close heat exchange relationship with the top surface 14 and the bottom surface 30 of hearth 10. In this heat exchange relationship, the hot temperatures on the surfaces 14 and 30 will be absorbed by the cooling fluid 78. As such, the present invention describes a cooling fluid jacketed hearth. Initially, the cooling fluid 78 is introduced from the heat exchange fluid reservoir 80 located exterior of the combustion chamber 40. A pump 82 will pump the heat exchange fluid from the reservoir 80 into the interior of the hearth 10 by way of flow line 84. The pump 82 and the reservoir 80 should have a suitable capacity for effectively cooling the hearth 10 during operation. Although it is believed that water, or other liquids, are the most effective fluids for heat exchange purposes, it may be also possible to use air, or other gases, as the heat exchange fluid. If air can be used instead of a liquid, one can get rid of water pumps and cooling towers. Since air is used for the burning processes of the combustion chamber 40, it could be readily available for use as the cooling fluid associated with the hearth of the present invention. However, if it cannot be an appropriate heat exchange fluid, then a liquid can be connected, by conventional means, to the interior of the hearth 10 for the purposes of cooling the surface 14 during the incineration of materials deposited thereon.

It is important to keep the temperature of the surface of the hearth 10 relatively low during combustion. If the temperature is very high, then the hearth 10 will quickly warp, deform, and become unsuitable for use. Also, it is important that slag not build up on the surface 14 of the hearth 10. Since the hearth itself is relatively cool, ash and glass does not stick to the hearth itself. Also, the ability to cool the hearth extends the life and usefulness of the hearth.

Figure 4:
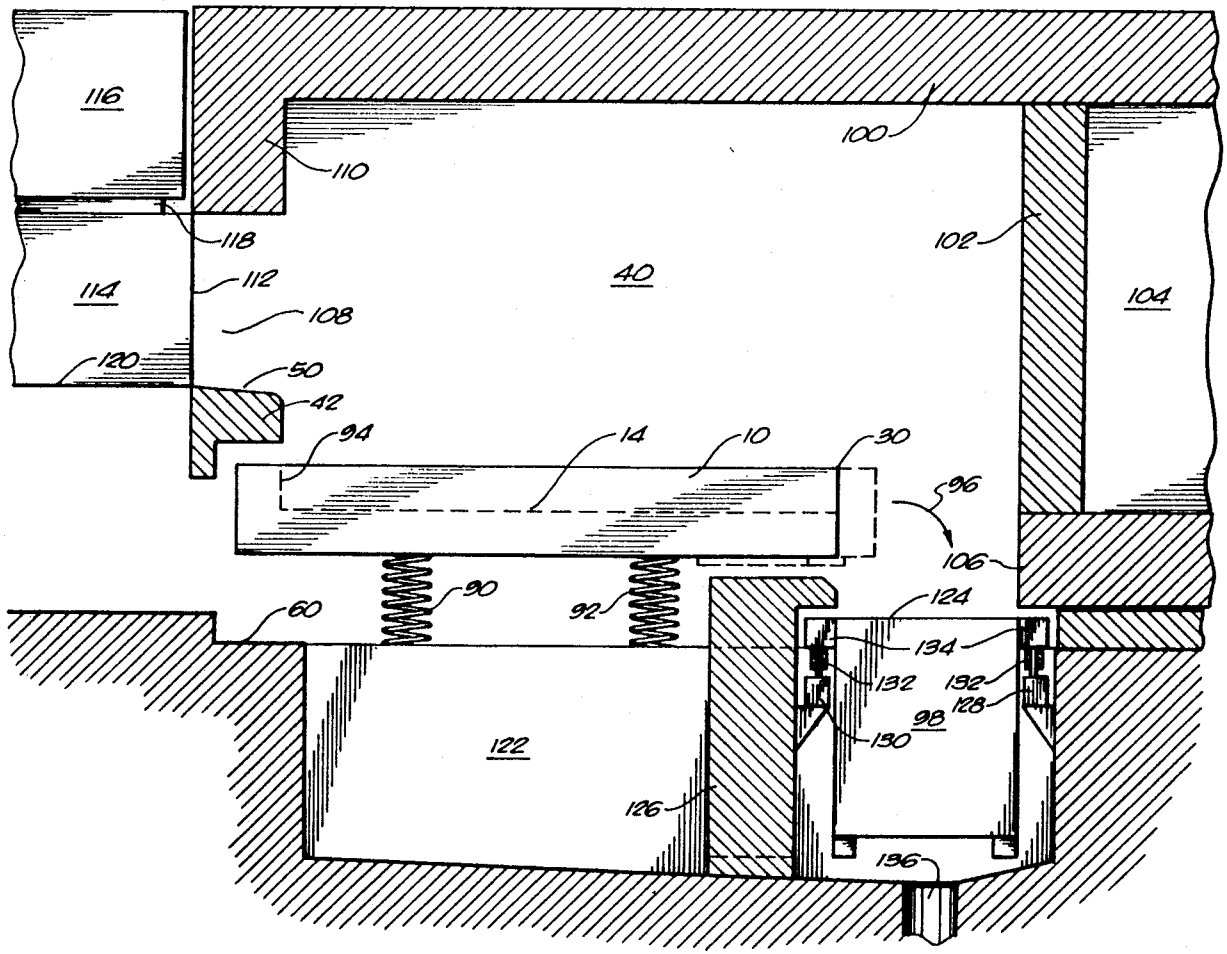
FIG. 4 is a cross-sectional view of the combustion chamber in accordance with the present invention showing, in particular, the motion of the hearth and the ash receptacle.

FIG. 4 illustrates a more complete illustration of the combustion chamber 40 in accordance with the preferred embodiment of the present invention. Specifically, it can be seen that the hearth 10 is positioned in the lower portion of the chamber 40. Hearth 10 is supported by large springs 90 and 92. As illustrated by the dotted lines at the end and top of hearth 10, the oscillator 93 is suitable for vibrating the hearth 10 in an up-down backward-forward motion pattern. The oscillator 93 is a motor-driven gear-and-cam drive. The oscillator 93 contains such a drive system so as to cause the desired motion of hearth 10. The motor within the oscillator 93 causes the hearth to shift in the direction indicated. During the combustion process, the hearth 10 adopts this pattern of motion so that the material conveyed onto the surface 14 of hearth 10 will gradually move from the end 94 to the end 30. As such the oscillator 93 is suitable for a proper incineration process. This oscillating system serves to remove any need for a stoking arm within the hearth. The motion imparted to the hearth 10 by the oscillator 93 effectively serves to move the ashen materials from end 94 to end 34. When the materials reach the end 34, the oscillating motion of the hearth 10 will cause the materials to pass outwardly in the direction of arrow 96 into ash pit 98.

In FIG. 4, it can be seen that the combustion chamber 40 includes a top refractory wall 100, a shadow wall 102 connecting the primary combustion chamber 40 with a secondary chamber 104, and a refractory wall 106. In conjunction with the refractory walls described herein previously, the configuration illustrated in FIG. 4 presents a complete combustion chamber in which the materials are surrounded, on all sides, by the suitable refractory walls. An opening 108 is formed between the refractory wall 110 and the refractory wall 42. This opening 108 allows the passage of to-be-incinerated materials into the combustion chamber 40. The face 112 of the ram 114 is refractory lined so as to form a suitable door (or covering) to combustion chamber 40 and be flush with the inner face of the refractory walls 110 and 42 when ram 114 is in the closed position. A ram will serve to push material through opening 108 across the top surface 50 of the lower refractory wall 42 and then onto the top surface 14 of hearth 10. At this stage, the material encounters the high temperatures of the combustion chamber 40 and incinerated. As the material is turned to ash, the ash is transmitted to the end 30 of hearth 10 by the oscillating motion caused by the oscillator 93. Springs 90 and 92 are mounted on the Frame 61 which is secured to the floor 60 in hearth access pit 122.

When the material is passed over the end 30 of the hearth 10, it falls into the ash pit 98. In FIG. 4, ash pit 98 is represented by an ash hopper 124. Ash hopper 124 is an enclosure that is suitable for receiving the ash 96 from the hearth 10. The ash hopper 124 is placed within the ash pit 98. Suitable supports 128 and 130 are provided so as to allow the ash hopper to be properly positioned. As can be seen, the ash hopper 124 has suitable connectors 132 that connect with the supports 134. Supports 134 are of a size and shape suitable for receipt by the forks of a fork lift truck. As such, the ash hopper 124 can be removed by mechanical means by accessing the ash hopper 124 with a fork lift. In this manner, the ash accumulation within the ash hopper 124 can be easily removed. A sump 136 is provided beneath the ash hopper 124 so as to remove any accumulation of material. The ash hopper 124 is of a self-tilting configuration. As such, the ash hopper 124 accentuates its use in the incinerator of the present invention.

Figure 5:
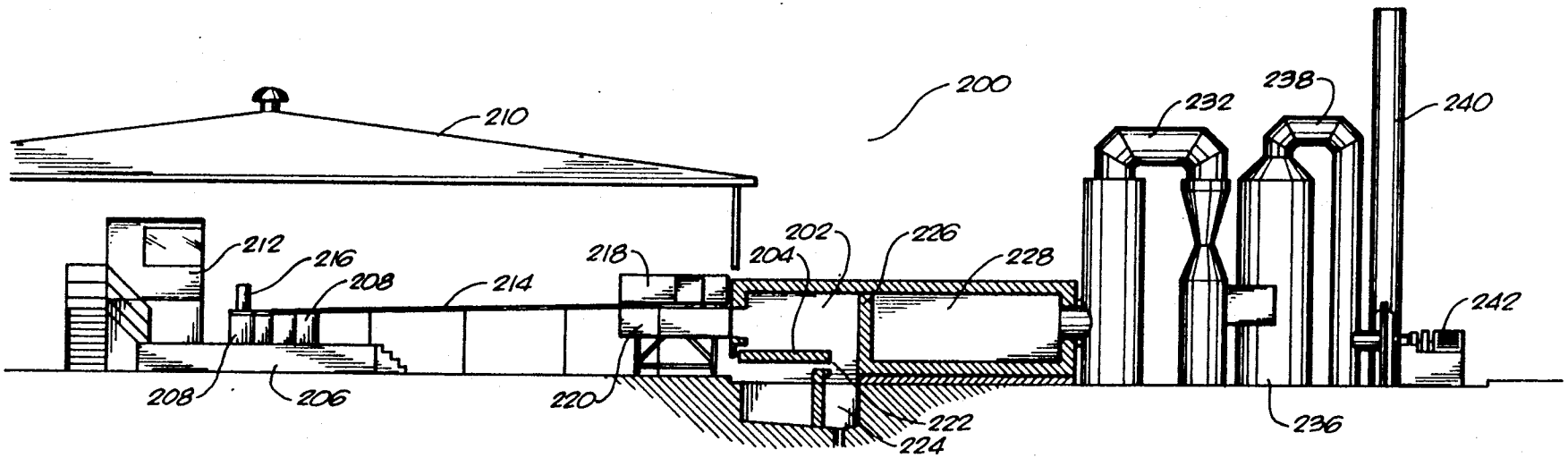
FIG. 5 is a diagrammatic view of the present invention.

Referring to FIG. 5, there is shown at 200, a waste disposal system utilizing the hearth and combustion chambers of the present invention. The waste disposal system 200 incorporates the combustion chamber 202 and a hearth 204. The waste disposal system 200 is particularly designed for the disposal of medical waste, both toxic and otherwise.

Once the waste enters the primary combustion chamber 202, the heat from the chamber will cause the incineration of the box 216. Once it enters the primary combustion chamber 202, the heat from the chamber will cause the incineration of the material and its conversion to ash. The oscillating hearth 204 will cause the ashen products to drift toward the end 222. Once at the end 222, the ashen products will drop into ash pit 224. The remaining gaseous components of the waste pass through the shadow wall 226 into the secondary combustion chamber 228. The gaseous components will be further incinerated within the secondary chamber 228.

In the system 200, the ashen products found in ash pit 224 may be removed and properly disposed of. Any toxicity found in the remaining materials is effectively eliminated by the process 200 of the present invention.

As used herein, the hearth of the present invention offers a number of advantages over prior art hearths. First, the hearth of the present invention allows for the effective burning of any materials, toxic and otherwise, placed thereon. The utilization of the air passageways, and air barriers, serves to cause a complete burn of the materials that are placed on the hearth. Particulate matter, slag, and other products are not distributed elsewhere within the system. The utilization of the air barriers effectively prevents a clogging or the system. As such, the present invention should be able to operate for a long continuous period without cleaning. This is particularly important considering the toxic nature of the materials that are incinerated in the system of the present invention.

The oscillating nature of the hearth of the present invention allows for the materials to be easily moved from one end of the hearth to the other. Complicated mechanisms using rams and stokers are eliminated. As such, the present invention offers a simpler technique and a less troublesome technique for the passing of ashen materials.

In most hearth designs, the disposal of certain material is quite difficult. Whenever certain materials are exposed to high temperatures, they will generally form a slag. Usually, this slag will stick to the hearth and effectively clog the system. The present invention, by utilizing a heat exchange circulation system, effectively prevents this slag build-up. The slag will not stick to the cooled surface of the hearth. Also, the use of the air passageways, that extend above the surface of the hearth, should prevent any liquid materials from flowing into the air plenum beneath the hearth. Liquids are effectively thermally converted before flowing to lower surfaces. Such liquids, toxic and otherwise, are retained on the surface of the hearth until properly thermally converted.

The foregoing disclosure and description of the invention is illustrative and explanatory thereof, and various changes in the details of the illustrated apparatus, and associated system, may be made within the scope of the appended claims without departing from the true spirit of the invention. The present invention should be limited by the following claims and their legal equivalents.

We claim:

1. A hearth comprising:

a body having a surface for the receipt of materials, said body comprising:

a first flange extending upwardly above said surface on one side of said body; and a second flange extending upwardly above said surface on another side of said body opposite said first flange; and a third flange extending upwardly above said surface on an end of said body, said first, second and third flanges for containing said materials on said surface;

a heat exchange fluid circulation means formed on an interior of said body, said circulation means for passing a fluid in heat exchange relationship with said surface; and oscillation means connected to said body for enabling said body to oscillate.

2. The hearth of claim 1, said surface having a collection ridge formed along one edge of said body.

3. The hearth of claim 1, said body having a plurality of air passageways extending therethrough, said air passageways opening on said surface, said air passageways opening on a side of said body opposite said surface.

4. The hearth of claim 3, each of said air passageways comprising a tube extending through said body, said tube extending above said surface of said body.

5. The hearth of claim 1, said heat exchange fluid circulation means comprising a fluid passageway contained within said body, said fluid passageway for passing air in close proximity to said surface.

6. The hearth of claim 1, said oscillation means comprising a motor connected to said body, said motor interactive with said body for causing said body to move in an up-down backward-forward motion pattern.

7. A hearth comprising:

a body having a surface for the receipt of material, said body comprising:

a first flange extending upwardly above said surface on one side of said body; and a second flange extending upwardly above said surface on another side of said body opposite said first flange; and a third flange extending upwardly above said surface on an end of said body, said first, second and third flanges for containing said materials on said surface;

a plurality of air passageways extending through said body, said air passageways opening at said surface, said air passageways opening on a side of said body opposite said surface; and a heat exchange fluid circulation means formed on an interior of said body, said heat exchange fluid circulation means for passing a fluid in heat exchange relationship with said body.

8. The hearth of claim 7, said surface having a collection ridge formed along one edge of said body opposite said third flange.

9. The hearth of claim 7, each of said air passageways comprising a tube extending through said body, said tube extending above said surface of said body.

10. The hearth of claim 7, further comprising:

oscillation means connected to said body for enabling said body to oscillate in an up-down backward-forward motion pattern.

11. A combustion chamber for an incinerator comprising:

a chamber having a plurality of refractory side walls, said chamber having an opening for the delivery of materials into said chamber;

a hearth contained within said chamber, said hearth having a surface for the receipt of said materials, said hearth positioned generally adjacent said opening;

oscillation means connected to said hearth for causing said hearth to oscillate within said chamber; and an air plenum arranged beneath said hearth in said chamber, said hearth positioned within said chamber such that air passes around at least two sides of said hearth from said air plenum, said hearth comprising:

a first flange extending upwardly above said surface on one side of said hearth;

a second flange extending upwardly above said surface on another side of said hearth opposite said first flange;

a third flange extending upwardly above said surface on an end of said hearth, said first, second and third flanges for containing said materials on said surface, said air passing from said air plenum around said first, second and third flanges so as to create a barrier to the passage of said materials from said surface over said first, second and third flanges.

12. The combustion chamber of claim 11, said chamber further comprising:

an ash receiving means formed in said chamber adjacent an end of said hearth opposite said opening, said ash receiving means defined by a plurality of refractory walls.

13. The combustion chamber of claim 11, said hearth having a plurality of air passageways extending therethrough, said air passageways opening on said surface, said air passageways opening on a side of said hearth opposite said surface, said air passageways communicating with said air plenum such that pressurized air passes from said air plenum through said passageways.

14. The combustion chamber of claim 13, each of said air passageways comprising a tube extending through said body, said tube extending above said surface of said body, said surface of said hearth having a collection ridge formed along one edge of said body.

15. The combustion chamber of claim 11 further comprising:

heat exchange fluid circulation means formed on the interior of said hearth for passing a fluid in heat exchange relationship with said body; and a heat exchange fluid supply connected to said heat exchange fluid circulation means, said heat exchange fluid supply being exterior of said chamber, said heat exchange fluid supply for delivering a heat exchange fluid to said hearth.

* * * * *